US006886430B1

(12) United States Patent
Tremblay et al.

(10) Patent No.: US 6,886,430 B1
(45) Date of Patent: May 3, 2005

(54) COMBINATION RATCHET/BREAKER BAR WRENCH

(76) Inventors: Theodore C. Tremblay, 7 Page Rd., Bedford, MA (US) 01730; Gary S. Tremblay, 9 Page Rd., Bedford, MA (US) 01730

( * ) Notice: Subject to any disclaimer, the term of this patent is extended or adjusted under 35 U.S.C. 154(b) by 0 days.

(21) Appl. No.: 10/961,878

(22) Filed: Oct. 8, 2004

Related U.S. Application Data

(60) Provisional application No. 60/511,241, filed on Oct. 14, 2003, and provisional application No. 60/538,828, filed on Jan. 23, 2004.

(51) Int. Cl.[7] ..... B25B 23/16

(52) U.S. Cl. ..... 81/177.8; 81/177.7; 81/177.75

(58) Field of Search ..... 81/177.8, 177.75, 81/177.9, 177.7, 60, 61, 62, 63.1, 63.2

(56) References Cited

U.S. PATENT DOCUMENTS 2,886,998 A * 5/1959 Scott ..... 81/177.9
4,676,703 A * 6/1987 Swanson ..... 408/239 R
5,619,890 A * 4/1997 Hattori et al. ..... 81/59.1
6,000,302 A * 12/1999 Chiang ..... 81/177.8
6,148,698 A * 11/2000 Hsieh ..... 81/177.8
6,216,567 B1 * 4/2001 Hu ..... 81/177.9
6,295,898 B1 * 10/2001 Hsieh ..... 81/177.8

* cited by examiner

*Primary Examiner*—Lee D. Wilson
*Assistant Examiner*—Alvin J Grant
(74) *Attorney, Agent, or Firm*—Pandiscio & Pandiscio

(57) ABSTRACT

Apparatus and methods for applying torque to a socket wrench are disclosed. The apparatus comprising a handle, a ratchet head, the handle and the ratchet head pivotally joined to one another, a ratchet mechanism having a first drive spline and a rotation control, the first drive spline extending substantially orthogonal to the longitudinal axis of the ratchet head, the first drive spline selectively rotatable with respect to the ratchet head, and the first drive spline configured to apply a first given torque to the socket wrench, and a second drive spline extending substantially parallel to the longitudinal axis of the ratchet head, the second drive spline fixedly secured to the ratchet head, and the second drive spline configured to apply a second given torque to the socket wrench.

14 Claims, 3 Drawing Sheets

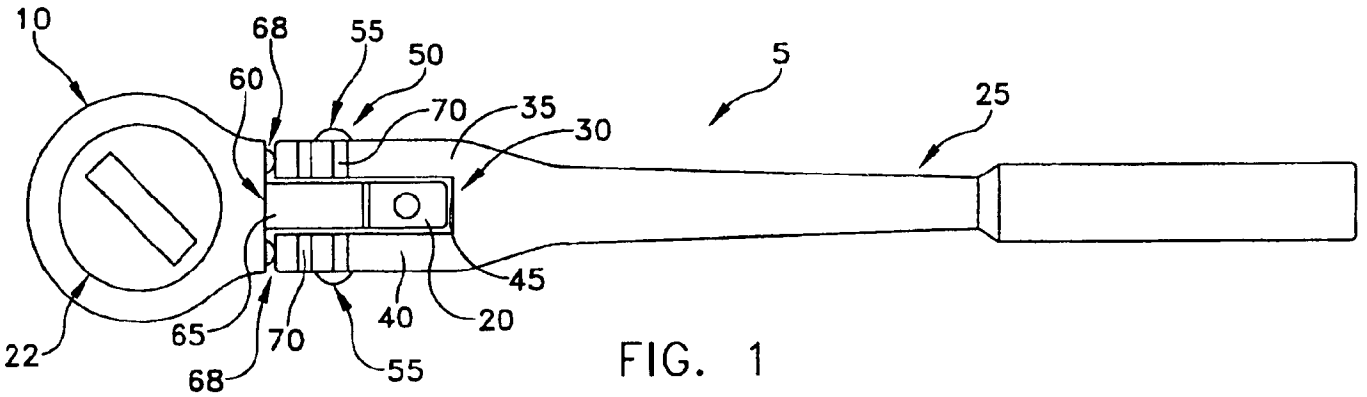
FIG. 1
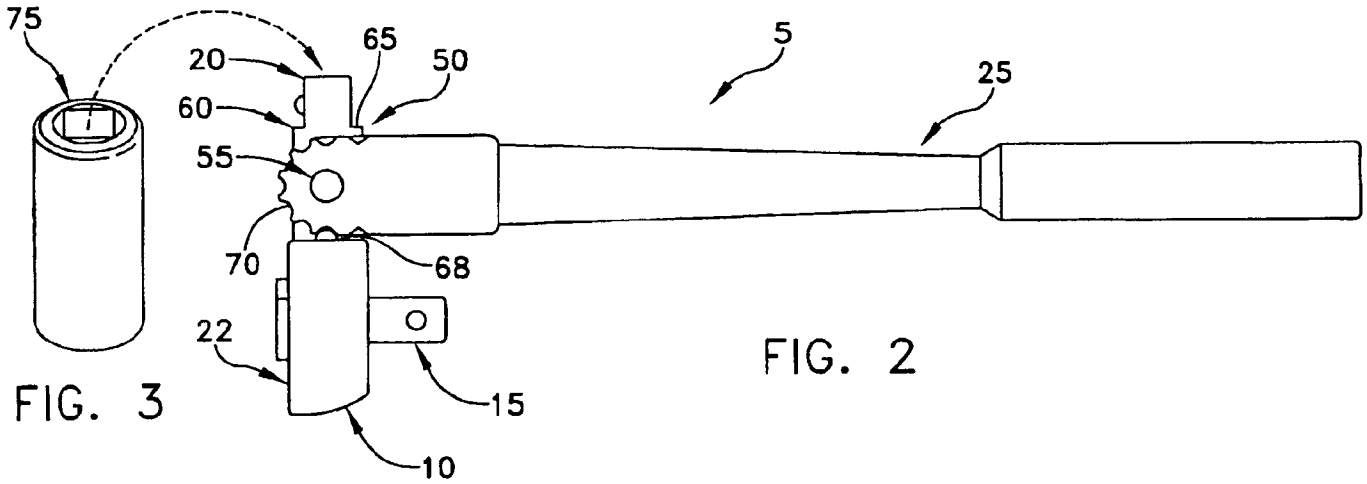
FIG. 2
FIG. 3

COMBINATION RATCHET/BREAKER BAR WRENCH

REFERENCE TO PENDING PRIOR PATENT APPLICATION

This patent application claims benefit of (1) pending prior U.S. Provisional Patent Application Ser. No. 60/511,241, filed Oct. 14, 2003 by Theodore C. Tremblay et al. for COMBINATION RATCHET BREAKER BAR WRENCH, and (2) pending prior U.S. Provisional Patent Application Ser. No. 60/538,828, filed Jan. 23, 2004 by Theodore C. Tremblay et al. for RATCHET-BREAKER-BAR-WRENCH, which patent applications are hereby incorporated herein by reference.

FIELD OF THE INVENTION

This invention is related to hand tools in general, and more particularly to hand tools for applying torque using a socket wrench and a breaker bar.

BACKGROUND OF THE INVENTION

As it is well known, a ratchet wrench facilitates the removal of fasteners such as nuts and bolts. However, ratchets are not a strong tool. A ratchet wrench should not be used to remove a tight bolt, such as a head bolt on an engine, or corroded fasteners, etc.

The ratchet mechanism is usually made up of two parts, a pawl and ratchet wheel. These parts will wear out quickly if forces of over-rated stress are applied to the ratchet wrench. A ratchet wrench is typically used on bolts that are not very tight or have been loosened with a breaker bar.

A breaker bar is a simple, strong tool. It is usually a bar used as a lever with a flexible end. The end is usually a square spline that enters into a socket wrench, a great amount of torque may be exerted with this mechanical advantage.

It would be a great convenience to combine both of these wrenches into a combination wrench.

SUMMARY OF THE INVENTION

An object of the invention is to provide a combination wrench configured for use as a ratchet wrench and a breaker bar.

Another object of the invention is to provide a combination wrench having a handle with a ratchet wrench spline and a breaker bar spline disposed at a single end thereof.

A further object of the present invention is to provide a combination wrench configured to store the breaker bar spline within a forked portion of the handle adjacent to the ratchet head when the breaker bar is not in use.

With the above and other objects in view, as will hereinafter appear, there is provided apparatus for applying torque to a socket wrench, the apparatus comprising:

- a handle having a first end and a second end, a line extending between the first end and the second end defining a handle longitudinal axis, and a first connector portion formed at the first end thereof;
- a ratchet head having third end and a fourth end, a line extending between the third end and the fourth end defining a ratchet head longitudinal axis, a second connector portion disposed between the third end and the fourth end, and the first connector portion and the second connector portion configured to pivotally join the handle and the ratchet head to one another;

- a ratchet mechanism disposed between the first connector portion and the third end of the ratchet head, the ratchet mechanism having a first drive spline and a rotation control, the first drive spline extending substantially orthogonal to the ratchet head longitudinal axis, the first drive spline selectively rotatable with respect to the ratchet head, and the first drive spline configured to apply a first given torque to the socket wrench; and
- a second drive spline disposed at the fourth end of the ratchet head, the second drive spline extending substantially parallel to the ratchet head longitudinal axis, the second drive spline fixedly secured to the ratchet head, and the second drive spline configured to apply a second given torque to the socket wrench.

In accordance with a further feature of the invention, there is provided a method for applying different amounts of torque to a socket wrench, the method comprising:

providing apparatus for applying torque to the socket wrench, the apparatus comprising:

- a handle having a first end and a second end, a line extending between the first end and the second end defining a handle longitudinal axis, and a first connector portion formed at the first end thereof;
- a ratchet head having third end and a fourth end, a line extending between the third end and the fourth end defining a ratchet head longitudinal axis, a second connector portion disposed between the third end and the fourth end, and the first connector portion and the second connector portion configured to pivotally join the handle and the ratchet head to one another;
- a ratchet mechanism disposed between the first connector portion and the third end of the ratchet head, the ratchet mechanism having a first drive spline and a rotation control, the first drive spline extending substantially orthogonal to the ratchet head longitudinal axis, the first drive spline selectively rotatable with respect to the ratchet head, and the first drive spline configured to apply a first given torque to the socket wrench; and
- a second drive spline disposed at the fourth end of the ratchet head, the second drive spline extending substantially parallel to the ratchet head longitudinal axis, the second drive spline fixedly secured to the ratchet head, and the second drive spline configured to apply a second given torque to the socket wrench;

attaching the socket wrench to the first drive spline;

applying a first amount of torque to the socket wrench using the ratchet mechanism;

removing the socket wrench from the first drive spline;

attaching the socket wrench to the second drive spline; and applying a second amount of torque to the socket wrench using the second drive spline fixedly secured to the ratchet head.

The above and other features of the invention, including various novel details of construction and combination of parts and method steps will now be more particularly described with reference to the accompanying drawings and pointed out in the claims. It will be understood that the particular devices and method steps embodying the invention are shown by way of illustration only and not as limitations of the invention. The principles and features of this invention may be employed in various and numerous embodiments without departing from the scope of the invention.

BRIEF DESCRIPTION OF THE DRAWINGS

These and other objects and features of the present invention will be more fully disclosed or rendered obvious by the following detailed description of the preferred embodiments of the invention, which are to be considered together with the accompanying drawings wherein like numbers refer to like parts, and further wherein:

FIGS. 1 and 2 illustrate a combination wrench having a ratchet drive spline and a breaker bar drive spline 20;

FIGS. 3 and 7 each illustrate a socket wrench for use together with the present invention;

FIG. 4 illustrates a breaker bar;

FIGS. 5, 6, and 8–11 illustrate alternative embodiments of a combination ratchet wrench and breaker bar tool with various ratchet mechanisms.

DETAILED DESCRIPTION OF THE PREFERRED EMBODIMENTS

Figures 4, 5, 6, 7:
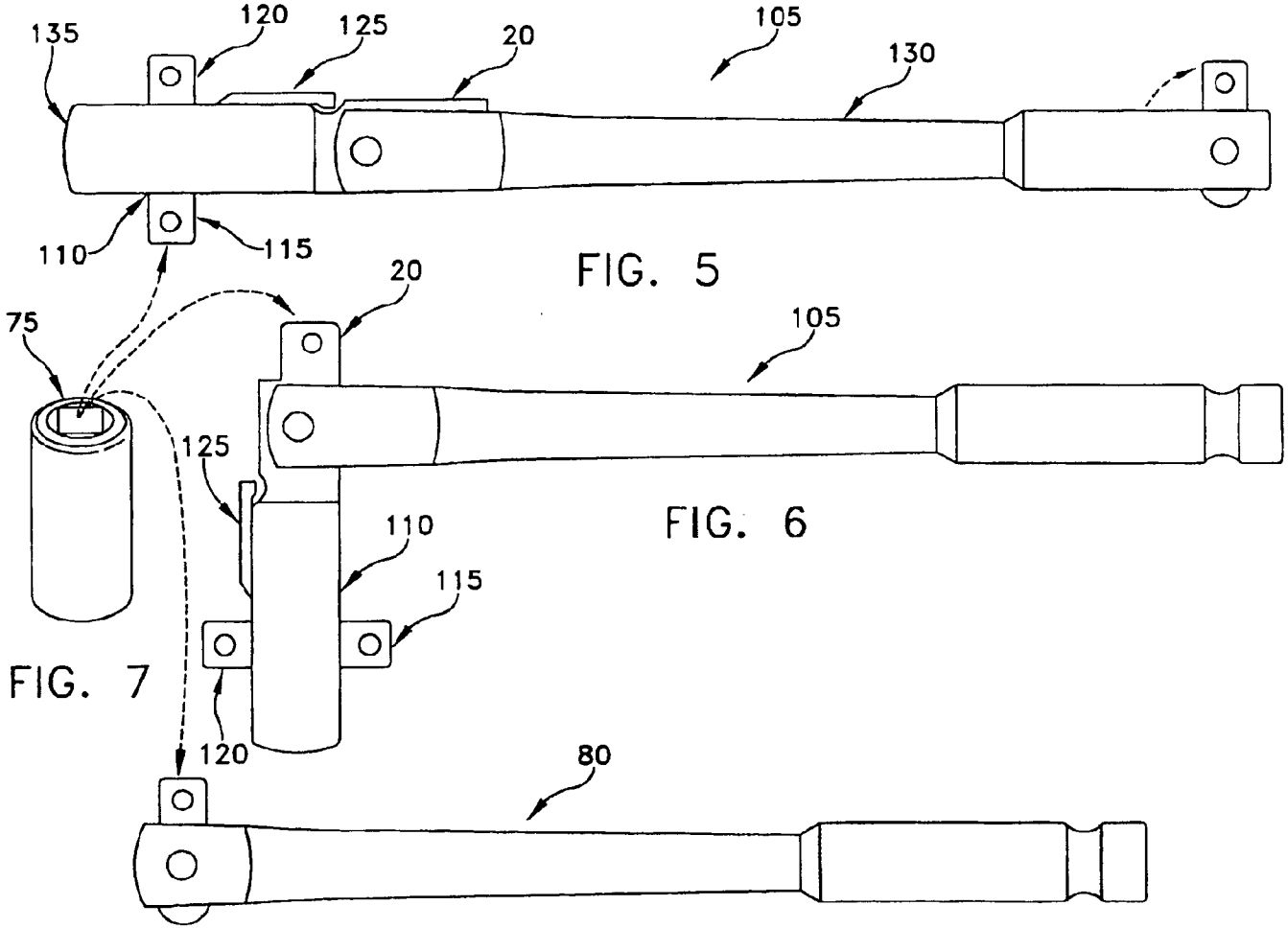

Referring to FIGS. 1 and 2, and in a preferred embodiment of the present invention, there is shown a combination wrench 5 having a ratchet head 10 with a ratchet drive spline 15 (FIG. 2) and a breaker bar drive spline 20. A ratchet mechanism 22 is disposed in ratchet head 10 to selectively actuate ratchet drive spline 15. A handle 25 is in pivotal attachment with socket head 10.

Handle 25 forms a fork portion 30 having a first arm 35 and a second arm 40 with an opening 45 formed therebetween. A connector portion 50 includes a passageway formed through first arm 35 and second arm 40, respectively. A pivot pin 55 is disposed through the passageway in the first arm 35 and the second arm 40.

A connection portion 60 of socket head 10 comprises a narrow section 65 configured for disposition between arm 35 and arm 40 of fork portion 30. Narrow section 65 forms a passageway therethrough configured to receive pivot pin 55 therein.

Still referring to FIGS. 1 and 2, and in a preferred embodiment of the present invention, there is shown a pair of spring ball plungers 68 extending from ratchet head 10, and a series of detent grooves 70 dipped on the ends of arms 35, 40. In this preferred embodiment of the present invention, spring ball plungers 68 and detent grooves 70 are components of connection portion 50 and connection portion 60, respectively. These components allow selective position of ratchet head 10 and handle 25 with respect to one another.

Referring to FIG. 1, breaker bar drive spline 20 is disposed within handle 25 so as to position ratchet drive spline 15 for use as a ratchet wrench. A socket wrench 75 is used alternately on both ratchet drive spline 15 and breaker bar drive spline 20. Ratchet drive spline 15 is preferably selected for fast ratcheting action with a minimum amount of torque. Breaker bar drive spline 20 is preferably selected for maximum application of torque to socket wrench 75 without the risk of wearing out ratchet mechanism 22 of ratchet drive spline 15.

Referring to FIGS. 1 and 2, and in a preferred embodiment of the present invention, handle bar 25 of the wrench 5 is integral with fork 30 to receive breaker bar drive spline 20, which is an integral protruberant part of ratchet head 10. Breaker bar spline 20 is preferably a square protuberance configured to accept socket wrench 75. Both ratchet head 10 and forked breaker bar handle 25 are hinged together at connector portions 50, 60 by pivot pin 55 so that ratchet head 10 can rotate about 90° in either direction. Ratchet head 10 preferably has two spring ball to align correspondingly to grooves in handle 25.

Combination wrench 5 has properties preferable of both a conventional ratchet wrench (not shown) and a conventional breaker bar 80 (see FIGS. 3 and 7). Combination wrench 5 is used as breaker bar by taking advantage of handle bar 10 and the protruding portion of breaker bar drive spine 20 at the rear of ratchet head 10 beyond pivot pin 55. When the breaker bar function is not required, breaker bar drive spline 20 folds into handle 25 between arms 35, 40 of fork 30.

Combination wrench 5 will simplify a job of a mechanic to loosen spark plugs on an engine using socket wrench 75 attached to breaker bar drive spline 20. This is especially advantageous for situations when the spark plugs are too tight for a typical ratchet wrench. After the spark plugs are loosened, the mechanic removes wrench 75, conveniently flips over ratchet head 10, and reinstalls socket wrench 75 on ratchet drive spline 15 such that in just a few seconds the mechanic is in a fast ratchet mode.

Other advantages of the present invention include, but are not limited to, elimination of the need to go to the tool box or to carry an extra tool.

For example, bridge worker using combination wrench 5 for installing or tightening bolts will only need one tool instead of two. This is especially important where weight is a factor.

Another example is a tire change kit which provides a combination wrench 5 to provide a fast, easy way for a motorist to change a tire.

Another advantage of the present invention is that ratchet head 10 provides a hold for one hand while the other hand is on handle 25 so as to simultaneously apply downward pressure to push socket wrench 75 onto a bolt or nut, and apply rotational torque to fasten or remove the same.

Referring now to FIGS. 5, 6, and 8–12, there are shown several alternative ways to make a combination ratchet wrench and breaker bar tool.

Referring to FIGS. 5 and 6, and in a preferred embodiment of the present invention, there is shown a combination wrench 105 having a ratchet mechanism 110 configured to apply torque to a selectively rotatable spline 115. A non-rotating spline 120 is configured opposite to selectively rotatable spline 115. A ratchet control lever 125 is preferably provided to operate selectively rotatable spline 115.

A handle bar 130 of ratchet 105 is preferably integral with a head portion 135. Non-rotating spline 120 is preferably assembled into head portion 135 to allow attachment of a flexible handle bar thereto. Socket wrench 75 (shown in FIGS. 3 and 7) is selectively attachable to spline 115 and spline 120.

Figure 8:
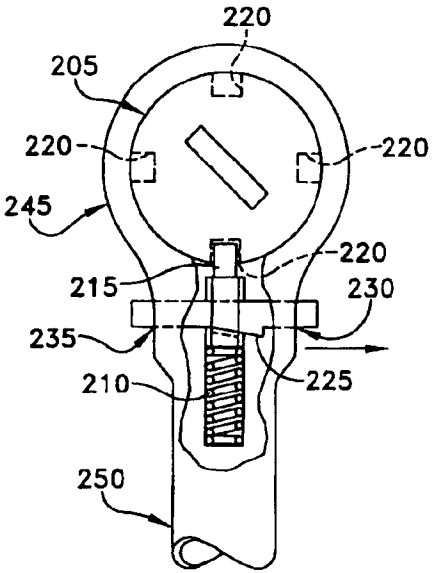

Referring to FIG. 8, there is shown a ratchet mechanism 205 having a spring 210 configured to push a bolt 215 toward a ratchet locking bolt hole 220. A cam 225 is actuated toward a first end 230 to selectively move bolt 215 into a locking mode and cam 225 is actuated toward end 235 to selectively move bolt 215 into an unlocked mode so as to allow rotation of ratchet mechanism within ratchet head 245 with respect to handle 250.

Figure 9:
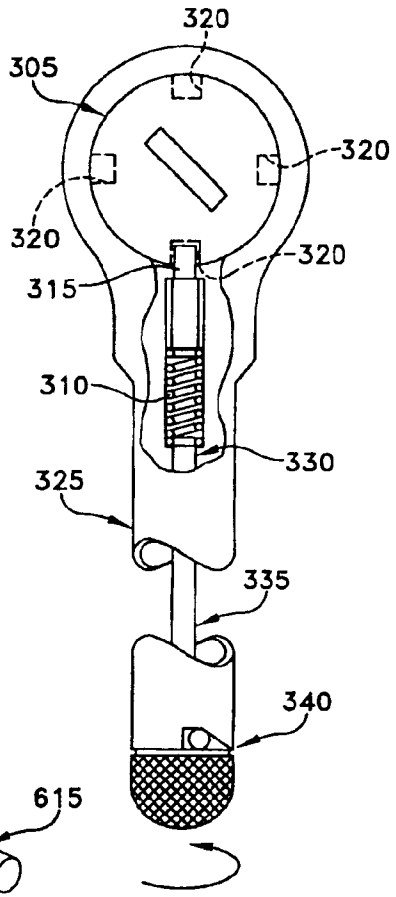

Referring to FIG. 9, there is shown a ratchet mechanism 305 having a spring 310 configured to push a bolt 315 toward a ratchet locking bolt hole 320. A handle 325 contains a swivel 330, a shaft 335, and a pin 340 in rotational connection with spring 310 so as to selectively position bolt 315 into ratchet locking bolt hole 320, and position ratchet mechanism 305 in a locking mode.

Figure 10:
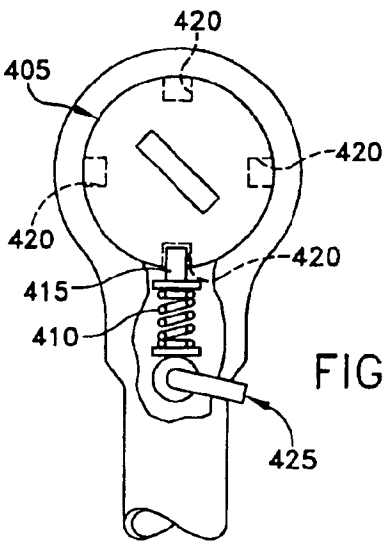

Referring to FIG. 10, there is shown a ratchet mechanism 405 having a spring 410 configured to push a locking bolt 415 in a direction away from a ratchet locking bolt hole 420. A cam 425 is preferably configured to selectively counteract the force of spring 410 so as to push locking bolt 415 toward ratchet locking bolt hole 420.

Figure 11:
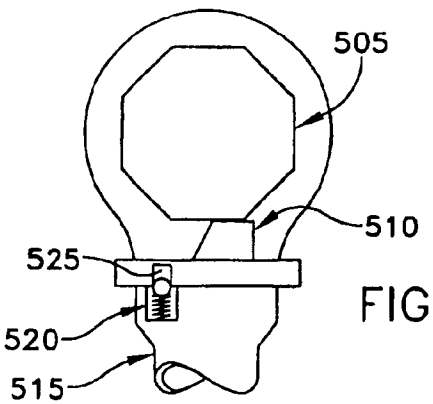

Referring to FIG. 11, there is shown a polygonal ratchet mechanism 505 configured to selectively engage with a sliding lock bolt 510 for selectively locking ratchet mechanism 505 with respect to a handle 515. Lock bolt 510 is held in place by selective engagement of a spring ball plunger 520 and a ball spring detent 525. Preferably, ball spring plunger 520 extends from a portion in attachment with handle 515 and ball spring detent 525 is configured in ratchet mechanism 505.

Figure 12:
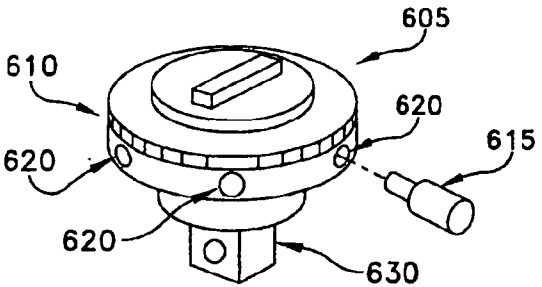
FIG. 12 illustrates an exploded view of a portion of a ratchet mechanism assembly.

Referring to FIG. 12, there is shown an exploded view 605 of a ratchet mechanism assembly 610. A lock bolt 615 is selectively engagable with lock bolt holes 620 contained in ratchet mechanism 610. A drive spline 630 extends away from rotation portion 615. Ratchet mechanism assembly 610 corresponds with analogous portions of ratchet mechanism 205 and lock bolt 215 shown in FIG. 8, analogous portions of ratchet mechanism 305 and lock bolt 315 shown in FIG. 9, and analogous portions of ratchet mechanism 405 and lock bolt 415 shown in FIG. 10.

What is claimed is:

1. Apparatus for applying torque to a socket wrench, the apparatus comprising:

a handle having a first end and a second end, a line extending between the first end and the second end defining a handle longitudinal axis, and a first connector portion formed at the first end thereof;

a ratchet head having third end and a fourth end, a line extending between the third end and the fourth end defining a ratchet head longitudinal axis, a second connector portion disposed between the third end and the fourth end, and the first connector portion and the second connector portion configured to pivotally join the handle and the ratchet head to one another;

a ratchet mechanism disposed between the first connector portion and the third end of the ratchet head, the ratchet mechanism having a first drive spline and a rotation control, the first drive spline extending substantially orthogonal to the ratchet head longitudinal axis, the first drive spline selectively rotatable with respect to the ratchet head, and the first drive spline configured to apply a first given torque to the socket wrench; and a second drive spline disposed at the fourth end of the ratchet head, the second drive spline extending substantially parallel to the ratchet head longitudinal axis, the second drive spline fixedly secured to the ratchet head, and the second drive spline configured to apply a second given torque to the socket wrench.

2. Apparatus according to claim 1 wherein the second drive spine is configured to apply greater maximum torque prior to failure than the first drive spline, and further wherein the second given torque is greater than the first given torque.

3. Apparatus according to claim 1 wherein the second drive spline is integral with the socket head.

4. Apparatus according to claim 1 wherein the first connector portion of the handle comprises a fork portion having a first arm and a second arm, the first arm and the second arm form an opening therebetween, the first arm and the second arm form a first passageway and a second passageway therethrough, respectively, and the second connector portion of the ratchet head forms a third passageway therethrough, the second connector portion is sized for disposition between the first arm and the second arm of the fork portion, and a pivot pin configured for placement through the first passageway, the second passageway, and the third passageway so as to pivotally connect the ratchet head and the handle to one another.

5. Apparatus according to claim 4 wherein the ratched head is configured to allow pivotal rotation of the second drive spline in a first plane parallel to the handle longitudinal axis, and the first arm and second arm of the fork portion are configured to prevent rotation of the second drive spline in a second plane orthogonal to the first plane.

6. Apparatus according to claim 4 wherein a first spring loaded ball bearing and a second spring loaded ball bearing extend from the ratchet head toward the first arm and the second arm of the fork, respectively, and the first arm and the second arm each form a series of detents thereon, the detents configured to receive the first spring loaded bearing and the second spring loaded bearing therein, respectively, so as to selectively maintain a given orientation of the ratchet head and the handle with respect to one another.

7. Apparatus according to claim 1 wherein the handle and the ratchet head are positionable with respect to one another so as to selectively position the handle longitudinal axis and the ratchet head longitudinal axis in a first configuration parallel to one another and in a second configuration substantially orthogonal to one another.

8. Apparatus according to claim 7 wherein the first configuration positions the second drive spline in the opening between the first arm and the second arm of the fork, with the first drive spline extending substantially orthogonal to the handle longitudinal axis so as to configure the first drive spline to drive the socket wrench, and the second configuration positions the second drive spline substantially orthogonal to the handle longitudinal axis so as to allow the second drive spline to drive the socket wrench.

9. Apparatus according to claim 7 wherein the first configuration is a ratchet wrench, and the second configuration is a breaker bar.

10. Apparatus according to claim 1 wherein the first given torque has a first maximum value prior to failure of the ratchet mechanism, the second given torque has a second maximum failure prior to failure of one of the socket wrench and the second drive spline, and further wherein the second maximum value of the second given torque of the second drive spline is greater than the first maximum value of the first given torque of the ratchet mechanism.

11. Apparatus according to claim 1 wherein the ratchet mechanism comprises a pawl and a ratchet wheel.

12. A method for applying different amounts of torque to a socket wrench, the method comprising:

apparatus for applying torque to a socket wrench, the apparatus comprising:

a handle having a first end and a second end, a line extending between the first end and the second end defining a handle longitudinal axis, and a first connector portion formed at the first end thereof;

a ratchet head having third end and a fourth end, a line extending between the third end and the fourth end defining a ratchet head longitudinal axis, a second connector portion disposed between the third end and the fourth end, and the first connector portion and the second connector portion configured to pivotally join the handle and the ratchet head to one another;

a ratchet mechanism disposed between the first connector portion and the third end of the ratchet head, the ratchet mechanism having a first drive spline and a rotation control, the first drive spline extending substantially orthogonal to the ratchet head longitudinal axis, the first drive spline selectively rotatable with respect to the ratchet head, and the first drive spline configured to apply a first given torque to the socket wrench; and a second drive spline disposed at the fourth end of the ratchet head, the second drive spline extending substantially parallel to the ratchet head longitudinal axis, the second drive spline fixedly secured to the ratchet head, and the second drive spline configured to apply a second given torque to the socket wrench;

attaching the socket wrench to the first drive spline;

applying a torque to the socket wrench using the ratchet mechanism;

removing the socket wrench from the first drive spline;

attaching the socket wrench to the second drive spline; and applying torque to the socket wrench using the second drive spline fixedly secured to the ratchet head.

13. A method according to claim 12 further comprising the step of pivoting the first connector and the second connector with respect to one another so as to position the second drive spline substantially orthogonal to the handle longitudinal axis prior to the step of attaching the socket wrench to the second drive spline.

14. A method according to claim 13 further comprising the step of pivoting the first connector and the second connector with respect to one another so as to position the second drive spline substantially parallel to the handle longitudinal axis subsequent to the step of applying torque to the socket wrench using the second drive spline.

* * * * *